United States Patent [19]

Swanson

[11] 4,274,179

[45] Jun. 23, 1981

[54] SPINNING FRAME APRON CLEARER ATTACHMENT

[75] Inventor: Kenneth P. Swanson, Ft. Lauderdale, Fla.

[73] Assignee: Progressive Equipment, Inc., Simpsonville, S.C.

[21] Appl. No.: 49,300

[22] Filed: Jun. 18, 1979

[51] Int. Cl.[3] ..... D01H 5/60

[52] U.S. Cl. ..... 19/245

[58] Field of Search ..... 19/245, 262, 267, 255

[56] References Cited

U.S. PATENT DOCUMENTS

| | | | |
|---|---|---|---|
| 2,075,595 | 3/1937 | Whiting | 19/245 X |
| 2,224,778 | 12/1940 | Callas | 19/245 X |
| 2,258,033 | 10/1941 | Presley | 19/245 X |
| 2,593,478 | 4/1952 | Newton | 19/262 X |
| 2,610,362 | 9/1952 | Bird | 19/245 |
| 3,906,590 | 9/1975 | Swanson | 19/267 |

FOREIGN PATENT DOCUMENTS

| | | | |
|---|---|---|---|
| 284770 | 5/1949 | Switzerland | 19/245 |

*Primary Examiner*—Louis Rimrodt

*Attorney, Agent, or Firm*—Bailey, Dority & Flint

[57] ABSTRACT

An apron clearer attachment is illustrated having disengagable mounting means carried adjacent one end thereof for positioning the clearer attachment upon a pivotal mounting adjacent a sliver guide which introduces fibers to an apron assembly. The apron clearer attachment is weighted and carries a clearer pad for maintaining the apron free of extraneous fibers, dirt and the like, which may tend to adversely affect the yarn being manufactured.

3 Claims, 3 Drawing Figures

SPINNING FRAME APRON CLEARER ATTACHMENT

BACKGROUND OF THE INVENTION

Apron clearers constructed in accordance with the prior art generally include a pad and have fixed connection to a bar mounted above the apron assembly extending across several assemblies. It is not possible to lift the clearer pads individually from the apron of a single apron assembly since at least two of the clearer pads are in fixed relation in respect to each other. Therefore, since the pads cannot compensate for individual apron assembly irregularities, one of the pads may not properly clean its respective apron.

Accordingly, an important object of this invention is to provide an individual spinning frame apron clearer attachment which may be raised without affecting the next adjacent clearer.

Another important object of the invention is to provide an individual apron clearer which may compensate for variation in apron arrangements by pivotal mounting upon a sliver guide for the cradle assembly, and by being thus positioned not unduly interfere with the essential spinning operation.

The clearer attachment of the present invention may be useful upon most cradle assemblies including those illustrated in U.S. Pat. Nos. 3,872,546 and 3,906,590.

SUMMARY OF THE INVENTION

It has been found that individual apron clearers may be provided for cradle assemblies by providing a pivotal mounting adjacent an upper mounting portion of a sliver guide which feeds fibers into the cradle assembly, and by providing suitable means such as upwardly extending arms for carrying the mounting means on one end with downwardly extending weighted support for the clearer pad at the other end. The clearer assembly may compensate for variations in apron assemblies while maintaining accessibility to the drafting assemblies.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
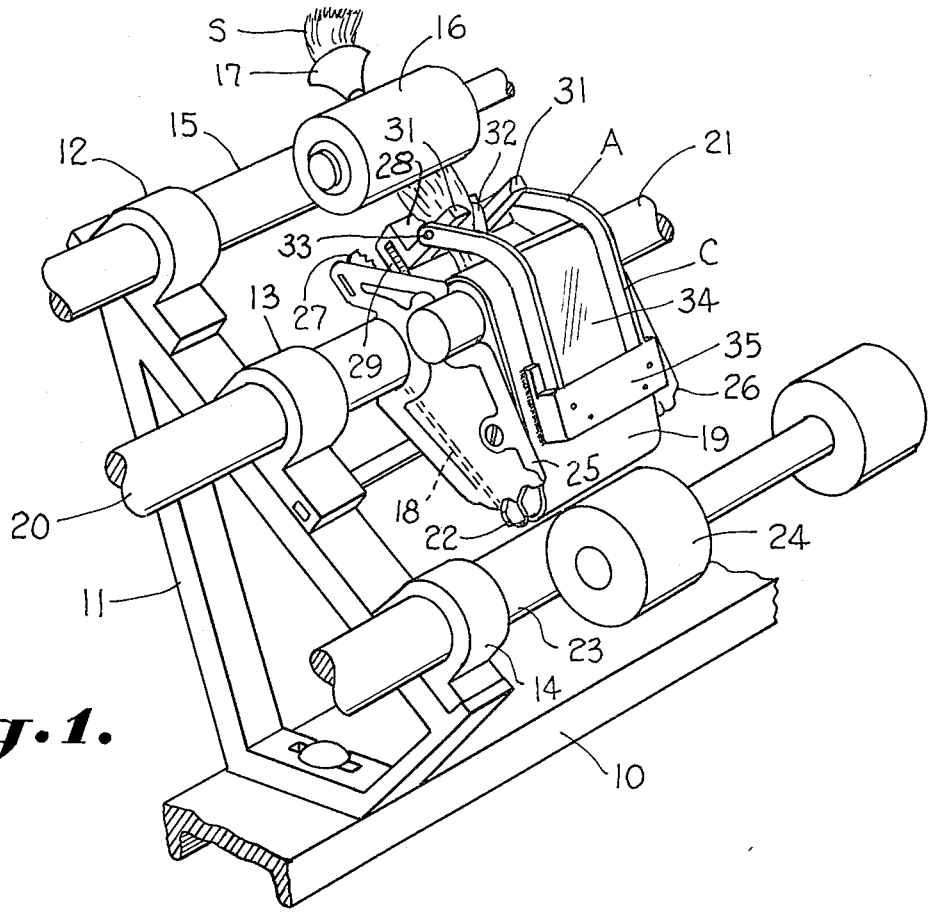
FIG. 1 is a perspective view illustrating a drafting system of a spinning frame carrying an apron clearer constructed in accordance with the present invention.
Figure 2:
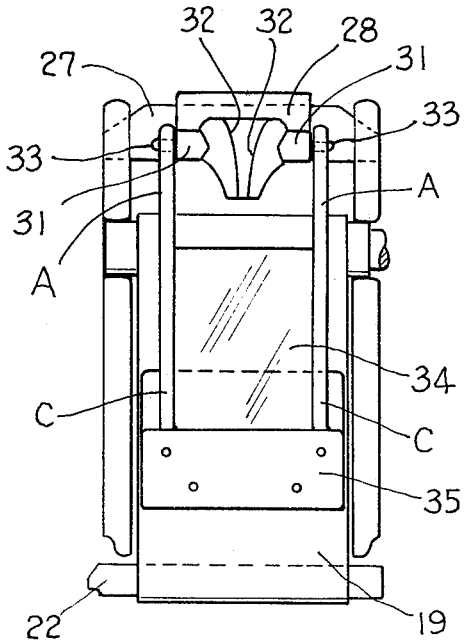
FIG. 2 is a top plan view of the apron clearer illustrated in FIG. 1.
Figure 3:
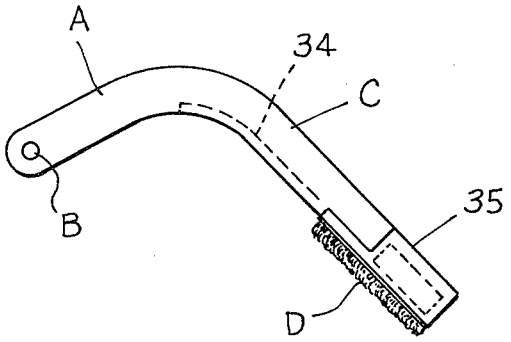
FIG. 3 is a side elevation of the apron clearer.

The drawing illustrates an apron clearer attachment for use and positioning upon an upper mounting support portion of a sliver guide. Spaced aligned upwardly extending arms A have disengagable mounting means B carried adjacent one end of the arms. Downwardly extending support means C are carried adjacent the other end of the arms. A clearer pad D is carried by and extends across the downwardly extending support means. The mounting means are illustrated as pivotal attachments carried for yieldable disengagement upon the upper mounting support portion of the sliver guide.

The drafting assembly illustrated is positioned upon the beam 10 which is a part of the frame support system of the spinning frame. The drafting system includes a plurality of spaced roll stands 11, each of which carries bearings 12, 13 and 14 for the back bottom roll, middle bottom roll, and front bottom roll, respectively. These rolls are rotated at different speeds in the usual manner in order to attenuate the yarn. The back bottom roll is illustrated at 15 cooperating with the back top roll 16 to form a nip for receiving sliver S delivered thereto from the creel through the usual trumpet 17. The fibrous strand thereafter passes into an entrance nip between a pair of opposed aprons 18 and 19. The apron 18 is carried upon the middle bottom roll 20, whereas, the apron 19 is carried by the middle top roll 21. The aprons pass around respective legs of the usual U-pin 22 adjacent the delivery point to the nip formed between the front bottom roll 23 and the front top roll 24 from whence the strand is delivered to suitable spindle means. The top roll cradle is illustrated as including a pair of side cradle members 25 and 26. These side cradle members are supported by the rotatable middle bottom roll 20 and the middle top roll 21. The side frame members 25 and 26 are maintained in spaced relationship in part by the cradle shelf 27, which is illustrated in the form of a flat bar maintained in substantially the same plane as the roll stand extending between the upper portion of each of the side frame members 25 and 26.

A sliver guide includes a U-shaped bracket having substantially horizontal legs 28 and 29. The legs 28 and 29 are joined on one side thereof. The legs 28 and 29 define an opening therein for receiving the flat bar or cradle shelf 27 therebetween in clamping engagement. The bracket is preferably constructed of molded somewhat flexible plastic, such as nylon, and the legs 28 and 29 are slightly biased towards each other so that the flat bar is received therebetween in resilient clamping engagement.

The sliver guide may be molded entirely of suitable plastic, and carries a pair of transversely spaced standards 31 extending upwardly therefrom. The standards are essentially in the form of posts but the inner surfaces thereof converge to carry an auxiliary member having complementary spaced converging side surfaces 32, and such converging surfaces guide and contain the sliver controlling the fibers thereof, immediately prior to their entrance into the nip between the apron members 18 and 19.

As has been previously pointed out the standards 31 and auxiliary member define an opening at the top therebetween for receiving a sliver S when laid in by the operator. During the opening operation, when the end comes down the operator twists the end for insertion into the trumpet 17 and after the strand passes through the nip formed by the back bottom roll and the back top roll it is laid by the operator between the standards of the sliver guide. It is evident that the sliver guide requires no adjustment and readily permits replacement by another sliver guide affording an indicated different spacing between the standards. Thus, a variety of sliver weights may be accommodated by simply changing the sliver guides. Since a separate unitary sliver guide is provided for each delivery, there is no problem of adjustment and replacement is easily accomplished when indicated.

The clearer attachment may be constructed of molded plastic such as polystyrene, nylon and the like and spaced aligned arms A, or similar suitable means for disengagable attachment to an upper portion of the sliver guide are provided. The disengagable mounting means carried by the arm A may be provided in the form of an opening illustrated at B, for fitting over outwardly extending spaced bars or pins 33. The arms A are bridged by a web member 34 and together with an extension of the arms A form a downwardly extending support means C for carrying the clearer pad, which is mounted upon an enlarged base member 35 extending across the downwardly extending support means C forming a weighting element for maintaining the clearer in engagement with the apron surface.

Accordingly, an individual clearer has been provided which may be removable, mounted in pivotal position in engagement with individual aprons. Apron clearers constructed in accordance with the present invention may be raised, removed, or adjusted independently of adjacent clearers and are individually positioned to avoid interference with the overall spinning operation.

While a preferred embodiment of the invention has been described using specific terms, such description is for illustrative purposes only, and it is to be understood that changes and variations may be made without departing from the spirit or scope of the following claims.

What is claimed is:

1. An apron clearer attachment for use and positioning upon an upper mounting support portion of a sliver guide through which an individual sliver is fed to an apron comprising:

aligned upwardly extending arms spaced to accommodate a single sliver guide;

disengageable mounting means carried adjacent one end of said arms for attachment adjacent said upper mounting support portion;

downwardly extending support means carried adjacent the other end of said arms; and a clearer pad carried by and extending across said downwardly extending support means.

2. The structure set forth in claim 1, wherein said mounting means are pivotal attachments carried for yieldable disengagement upon said upper mounting support portion of said sliver guide.

3. The structure set forth in claim 2, wherein said downwardly extending support means is weighted maintaining engagement of the pad with the apron.

* * * * *